United States Patent [19]

Fukumori et al.

[11] 4,275,690

[45] Jun. 30, 1981

[54] IGNITION DISTRIBUTOR

[75] Inventors: Yukitsugu Fukumori; Masazumi Sone, both of Yokohama, Japan

[73] Assignee: Nissan Motor Company, Limited, Kanagawa, Japan

[21] Appl. No.: 50,808

[22] Filed: Jun. 22, 1979

[30] Foreign Application Priority Data

Jul. 10, 1978 [JP] Japan ..... 53-82934

[51] Int. Cl.[3] ..... F02P 1/00; H04R 17/00

[52] U.S. Cl. ..... 123/146.5 A; 123/616; 123/642; 310/339

[58] Field of Search ..... 200/19 R, 19 M; 335/205-207; 310/339, 328; 315/55, 209 PZ; 123/146.5 A, 148 BA, 611-617, 642

[56] References Cited

U.S. PATENT DOCUMENTS

| | | | |
|---|---|---|---|
| 2,248,574 | 7/1941 | Knight | 310/339 X |
| 2,843,698 | 7/1958 | Knauth | 200/19 M X |
| 3,208,443 | 9/1965 | Hurwitz | 310/339 X |
| 3,221,213 | 11/1965 | McKinney | 315/209 PZ |
| 3,355,623 | 11/1967 | Konopa | 310/339 X |
| 3,397,683 | 8/1968 | Phillips | 310/339 X |
| 3,539,841 | 11/1970 | Riff | 310/339 |
| 3,737,691 | 6/1973 | Hoover | 123/148 BA X |
| 3,949,721 | 4/1976 | Hori et al. | 200/19 R X |

FOREIGN PATENT DOCUMENTS

| | | | |
|---|---|---|---|
| 2398191 | 3/1979 | France | 123/148 BA |

*Primary Examiner*—James R. Scott

*Attorney, Agent, or Firm*—Lowe, King, Price & Becker

[57] ABSTRACT

An ignition distributor is disclosed which comprises an input terminal, output terminals, a rotor adapted to rotate with rotation of an engine and provided at its one end with a magnet, a first electrode facing the rotor and coupled to the input terminal, a piezo-conductive plate placed on the surface of the first electrode opposite to the rotor, second electrodes formed of magnetic material and connected to the output terminals, respectively, and the second electrodes circumferentially arranged on the piezo-conductive plate. When the rotor rotates to bring the magnet below one of the second electrodes, the one second electrode is attracted to exert a pressure on the piezo-conductive plate so as to render it conductive thereby establishing an electrical connection between the input terminal and the output terminal connected to the one second electrode.

12 Claims, 8 Drawing Figures

IGNITION DISTRIBUTOR

BACKGROUND OF THE INVENTION

1. Field of the Invention

This invention relates to an ignition distributor for use in an internal combustion engine.

2. Description of the Prior Art

In conventional ignition distributors, spark ignition occurs in a small gap between two electrodes to conduct a high voltage applied to an input terminal to one of output terminals. Such spark ignition creates several difficult problems. First, it produces a noise field to have an adverse influence on broadcasting systems. Second, it produces undesirable gases such as oxides of nitrogen which accelerate corrosion of the electrodes and reduce their life. Third, it causes a loss of energy to be transmitted to ignition plugs which results in poor exhaust gas purifying performance and poor fuel economy.

SUMMARY OF THE INVENTION

It is therefore an object of the present invention to provide one quite satisfactory solution of the problems encountered with conventional ignition distributors.

Another object of the present invention is to provide a novel and improved ignition distributor in which high voltage distribution is taken place with no spark discharge.

According to the present invention, these and other objects are accomplished by an ignition distributor for use in an internal combustion engine, comprising an input terminal for connection to a high voltage source, a plurality of output terminals for connection to ignition plugs, respectively, a rotor adapted to rotate with rotation of the engine and provided at its one end with a magnet, a first electrode disposed to face the rotor and electrically connected to the input terminal, a piezo-conductive plate placed on the surface of the first electrode opposite to the rotor, second electrodes formed of magnetic material and electrically connected to the output terminals, respectively, and the second electrodes circumferentially arranged on the piezo-conductive plate for exerting a pressure on the portion of the piezo-conductive plate between the magnet and one of the second electrodes to render the portion conductive thereby making an electrical connection between the input terminal and the one output terminal connected to the one second electrode when the rotor rotates to bring the magnet below the one second electrode.

Other objects, means, and advantages of the present invention will become apparent to one skilled in the art thereof from the following description.

BRIEF DESCRIPTION OF THE DRAWINGS

The following explanation of several preferred embodiments of the present invention will help in the understanding thereof, when taken in conjunction with the accompanying drawings, which, however, should not be taken as limiting the present invention in any way, but which are given for purposes of illustration only. In the drawings, like parts are denoted by like reference numerals in the several figures, and.

DESCRIPTION OF THE PREFERRED EMBODIMENTS

Figure 1:
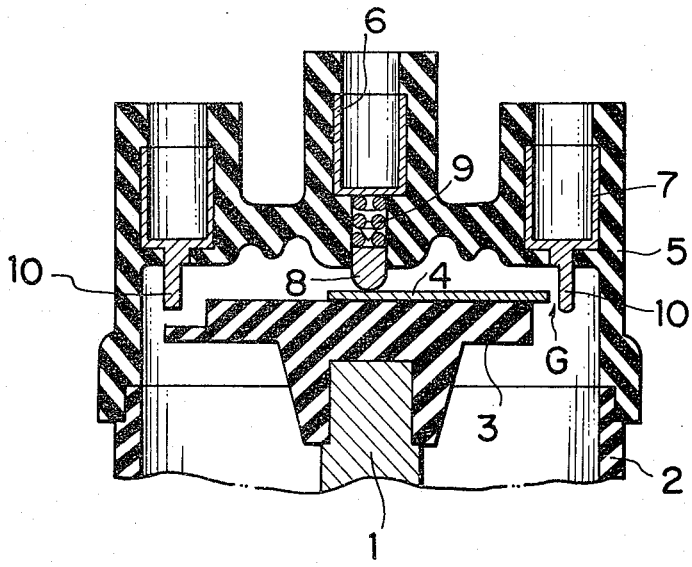
FIG. 1 PRIOR ART
FIG. 1 is a fragmentary sectional view showing the significant portion of a conventional ignition distributor.

Prior to the description of the preferred embodiments of the present invention, we shall briefly describe the prior art ignition distributor shown in FIG. 1 in order to specifically point out the difficulties attendant thereon.

In FIG. 1, the reference numeral 1 designates a cam shaft extending within a housing 2 and coupled to a crankshaft of an engine for rotation therewith. The distributor comprises an insulating rotor 3 secured at its lower side to the cam shaft 1 and provided on its upper surface with a rotor electrode 4, and a distribution cap 5 secured to the housing 2 and provided with a center input terminal 6 and a plurality of side output terminals 7 which are numbered in accordance with the cylinders incorporated in the engine. The center input terminal 6 is electrically connected to the rotor electrode 4 through a carbon electrode 8 and a spring 9 urging the carbon electrode 8 into contact with the rotor electrode 4. The side output terminals 7 are electrically coupled to side electrodes 10, respectively.

When a high voltage is applied from an ignition coil (not shown) through a high voltage cable (not shown) to the center input terminal 6, it is conducted through the spring 9 and the carbon electrode 9 to the rotor electrode 4. This causes dielectric breakdown of air in a small gap G between the rotor electrode 4 and one of the side electrodes 10 to transmit the high voltage to the one side electrode 10. The high voltage is then conducted through a high voltage cable (not shown) to a corresponding one of the ignition plugs.

In such conventional distributors, high voltage is conducted from the rotor electrode 4 to one of the side stationary electrodes 10 through spark discharge occurring in the gap G which normally has a distance of about 1 mm. However, such spark ignition creates several difficult problems. First, it produces a noise field which is spread around from the high voltage cable serving as an antenna to have an adverse effect on broadcasting systems. Second, it produces undesirable gases such as oxides of nitrogen which accelerate corrosion of the electrodes and reduce their life. Third, it causes a loss of energy to be transmitted to ignition plugs so that energy cannot be applied to the ignition plugs in an amount sufficient to reliably ignite fuel for high exhaust gas purification and high fuel economy.

Figure 2A:
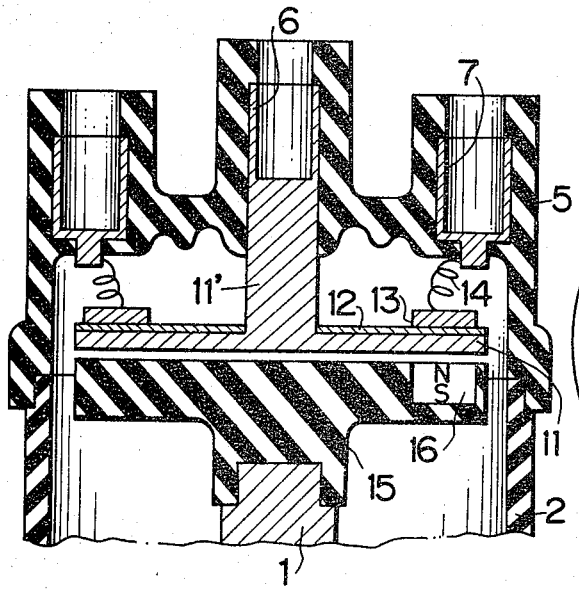
FIG. 2A is a fragmentary sectional view showing one embodiment of the ignition distributor of the present invention.
Figure 2B:
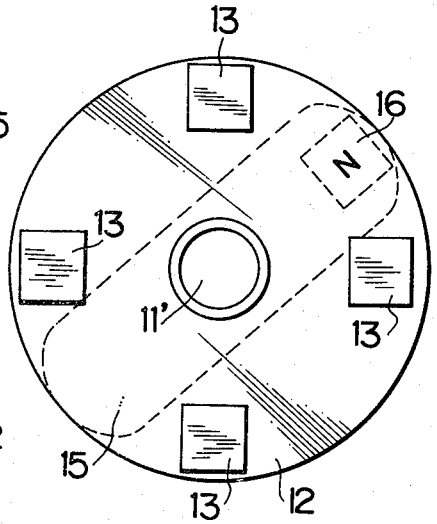
FIG. 2B is a plan view showing the second electrodes arranged on the piezo-conductive plate.

Referring to FIGS. 2A and 2B, there is illustrated a first embodiment of an ignition distributor made in accordance with the present invention. The ignition distributor comprises a disc-shaped stationary electrode 11 formed of a nonmagnetic material such as aluminium and formed integrally with a center rod 11' which is secured to the distribution cap 5 and electrically coupled to the center input terminal 6. The stationary electrode 11 has thereon a disc-shaped piezo-conductive plate 12 which is formed of silicon rubber mixed with conductive metal particles so as to serve as a conductor having a resistance of about several tens of ohms when applied with a pressure above a predetermined level such as one on the order of 0.1 to 2 kg/cm$^2$ and to serve as an insulator having a resistance of about several tens of megohms under a pressure below the predetermined level. A plurality of working electrodes 13 which is numbered in accordance with the number of the cylinders incorporated in the engine are positioned circumferentially and fixed on the piezo-conductive plate 12 such as by conductive adhesive. The working electrodes 13 are formed of a magnetic material such as soft iron and electrically connected through wires 14 to the side output terminals 7, respectively. The ignition distributor also comprises a rotor 15 coupled at its lower side to the cam shaft 1 and provided at its one end with a rod magnet 16. The magnet 16 may be a permanent magnet or electromagnet.

In operation, when the rotor 15 rotates with rotation of the cam shaft 1 to bring the magnet 16 below one of the working electrodes 13, the working electrode 13 is attracted downward to exert a pressure on the portion of the piezo-conductive plate 12 between the working electrode 13 and the magnet 16 so as to render the portion conductive. Thus, the high voltage applied to the center input terminal 6 is conducted through the established circuit including the rod 11', the stationary electrode 11, the portion of the piezo-conductive plate 12, the working electrode 13, the wire 14 and the side output terminal 7 to the corresponding one of the ignition plug. Similarly, the high voltage applied to the center input terminal 6 is sequentially distributed to the ignition plugs fitted in the respective cylinders when the magnet 16 passes below the respective working electrodes 13 with rotation of the rotor 15.

A samarium-cobalt magnet may be used as the magnet 16 to provide an increased attractive force so as to facilitate creation of a pressure sufficient to render the piezo-conductive plate 12 conductive.

Figure 3:
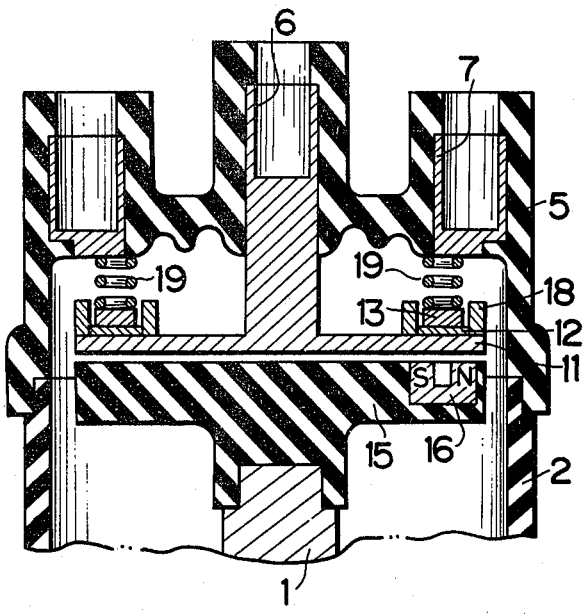
FIG. 3 is a fragmentary sectional view showing a second embodiment of the present invention.

Referring to FIG. 3, there is illustrated a second embodiment of the present invention which differs from the first embodiment only in that the wires 14 are removed and replaced with coil springs 19, respectively. The coil springs 19 serve to electrically connect the working electrodes 13 and also to urge the working electrodes 13 downward so as to provide a bias pressure on the piezo-conductive plate 12, whereby the piezo-conductive plate 12 can reliably be rendered conductive with a small attractive force. Insulating guide members 18 may be provided on the stationary electrode 11 for positioning the respective working electrodes 13, which restrict horizontal movement of the working electrodes 13 and allow vertical sliding movement thereof. As an example, the magnet 16 is illustrated as taken in the form of a horseshoe magnet.

Figure 4:
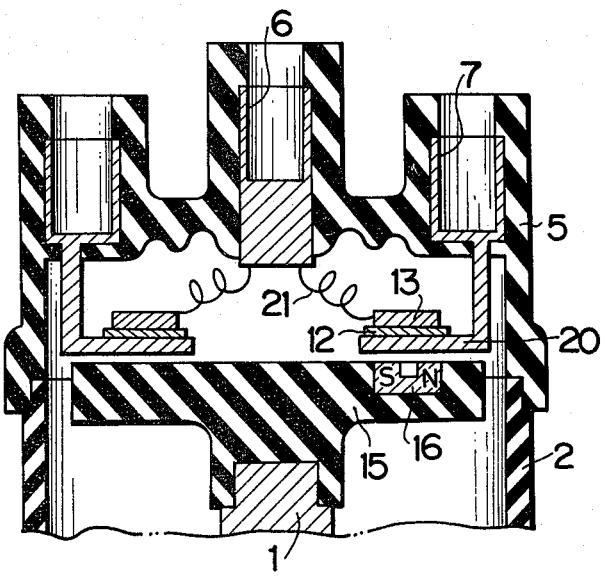
FIG. 4 is a fragmentary sectional view showing a third embodiment of the present invention.

Referring to FIG. 4, there is illustrated a third embodiment of the present invention which is similar to the first embodiment except that a stationary electrode 20 is provided for each side output terminal 7 and all of the working electrodes 13 are connected to the center input terminal through respective wires 21. In this embodiment, when the rotor 15 rotates to bring the magnet 16 below one of the stationary electrodes 20 to attract the corresponding working electrode 13 so as to render the corresponding piezo-conductive plate 12 conductive, the high voltage applied to the center input terminal 6 is conducted through the wire 21, the working electrode 13, the piezo-conductive plate 12, and the stationary electrode 20 to the corresponding side output terminal 7.

Figure 5:
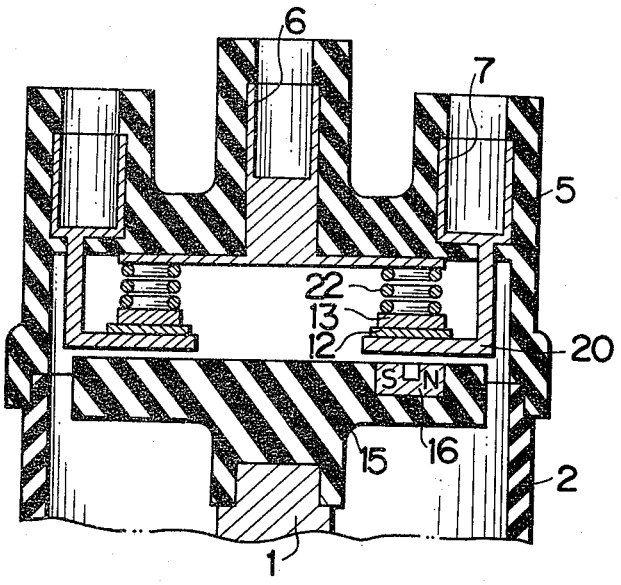
FIG. 5 is a fragmentary sectional view showing a fourth embodiment of the present invention.

Referring to FIG. 5, there is illustrated a fourth embodiment of the present invention which differs from the third embodiment only in that the wires 21 are removed and replaced with coil springs 22, respectively. The coil springs 22 serve to electrically connect the working electrodes 13 to the center input terminal 6 and also to urge the working electrodes 13 downward so as to provide a bias pressure on the piezo-conductive plate 12, respectively, so that the piezo-conductive plate 12 can reliably be rendered conductive with a small attractive force.

By the choice of the density and size of the metal particles mixed in the rubber of the piezo-conductive plate to adjust the resilient force thereof and/or by the choice of the mass and area of each working electrode 13, the speed with which the piezo-conductive plate 12 changes between its insulating and conductive conditions can be held high even if the rotor 15 rotates at high speeds.

Figure 6:
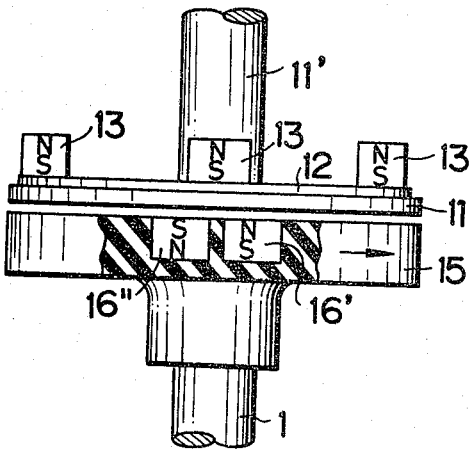
FIG. 6 is an elevational view showing a modification of the present invention.

FIG. 6 illustrates a modification of the present invention, in which each of the working electrodes 13 is taken in the form of a permanent magnet and two magnets 16' and 16'' different in polarity are embedded in the rotor 15. When the rotor 15 rotates in the arrow direction, the magnet 16' first attracts the working electrode 13 to place the piezo-conductive plate 12 in its conductive condition and then the magnet 16'' repels the working electrode 13 to return it to its insulating condition. This further increases the speed with which the piezo-conductive plate 12 changes between these two conditions.

The working electrodes are preferably made of, but are in no way limited to, ferromagnetic material or may be taken in the form of permanent magnets as shown in FIG. 6. In the latter case, a conductive plate may be sandwiched between the magnet and the piezo-conductive plate, which is connected through a wire to the center input terminal 6 or one of the side output terminals 7 since permanent magnets sometimes have poor conductivity.

Figure 7:
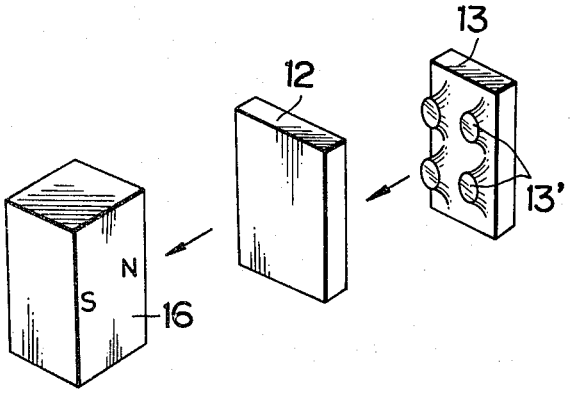
FIG. 7 is a perspective view showing another modification of the present invention.

FIG. 7 illustrates another modification of the present invention, in which each working electrode 13 is provided with projections 13' to increase the pressure exerted on the piezo-conductive plate 12.

It is therefore apparent that there has been provided, in accordance with the present invention, an ignition distributor which distributes a high voltage to a plurality of ignition plugs with no spark discharge and thus is free from disadvantages attendant with spark discharge that fully satisfies the objects, aims and advantages set forth above.

What is claimed is:

1. An ignition distributor for use in an internal combustion engine, comprising:

(a) an input terminal for connection to a high voltage source;

(b) a plurality of output terminals for connection to ignition plugs, respectively;

(c) first electrode means electrically connected to said input terminal or said output terminals;

(d) piezo-conductive plate means placed on said first electrode means;

(e) second magnetic electrode means placed on said piezo-conductive plate means;

(f) means for electrically connecting said second magnetic electrode means to said output terminals or said input terminal; and (g) a rotor disposed to face said first electrode means and provided at its one end with a magnet, said rotor adapted to rotate with rotation of said engine to bring said magnet below said second electrode means so that when said magnet comes below said second electrode means, it attracts said second electrode means to exert a pressure on a portion of said piezo-conductive plate means to render the same conductive, thereby making an electrical connection between said second electrode means and said first electrode means.

2. An ignition distributor for use in an internal combustion engine, comprising:

(a) an input terminal for connection to a high voltage source;

(b) a plurality of output terminals for connection to ignition plugs, respectively;

(c) a first electrode electrically connected to said input terminal;

(d) piezo-conductive plates placed on said first electrode;

(e) second electrodes formed of magnetic material and circumferentially arranged on said piezo-conductive plates, respectively;

(f) means for electrically connecting said second electrodes to said output terminals, respectively; and (g) a rotor disposed to face said first electrode and provided at its one end with a magnet, said rotor adapted to rotate with rotation of said engine to sequentially bring said magnet below said second electrodes so that when said magnet comes below one of said second electrodes, it attracts said one second electrode to exert a pressure on the corresponding one of said piezo-conductive plates to render the same conductive thereby making an electrical connection between said one second electrode and said first electrode.

3. The ignition distributor according to claim 2, in which said piezo-conductive plates form a disco-plate on the first electrode.

4. An ignition distributor according to claim 2, in which each of said second electrodes is electrically connected to the corresponding one of said output terminals through a spring urging said second electrode against said corresponding piezo-conductive plate to provide a bias pressure thereon, said spring having a magnitude of force to maintain said input and output terminals electrically isolated from each other in the absence of an attractive magnetic force.

5. An ignition distributor according to claim 1, in which each of said second electrodes 13 is in the form of a magnet.

6. An ignition distributor according to claim 5, in which said rotor is further provided with an additional magnet near said first described magnet, said additional magnet having a polarity opposite to that of said first magnet.

7. An ignition distributor according to claim 2, in which each of said second electrodes is provided with projections extending toward and in engagement with said piezo-conductive plate.

8. An ignition distributor for use in an internal combustion engine, comprising:

(a) an input terminal for connection to a high voltage source;

(b) a plurality of output terminals for connection to ignition plugs, respectively;

(c) first electrodes electrically connected to said output terminals, respectively;

(d) piezo-conductive plates placed on said first electrodes, respectively;

(e) second electrodes formed of magnetic material and placed on said piezo-conductive plates, respectively;

(f) means for electrically connecting said second electrodes to said input terminal; and (g) a rotor disposed to face said first electrodes, said rotor provided at its one end with a magnet and adapted to rotate with rotation of said engine to sequentially bring said magnet below said second electrodes so that when said magnet comes below one of said second electrodes, it attracts said one second electrode to exert a pressure on the corresponding one of said piezo-conductive plates to render the same conductive, thereby making an electrical connection between said one second electrode and the corresponding one of said first electrodes.

9. An ignition distributor according to claim 8, in which each of said second electrodes is electrically connected to said input terminal through a spring urging said second electrode against said corresponding piezo-conductive plate to provide a bias pressure thereon.

10. An ignition distributor according to claim 8, in which each of said second electrodes is in the form of a magnet.

11. An ignition distributor according to claim 10, in which said rotor is further provided with an additional magnet near said first described magnet, said additional magnet having a polarity opposite to that of said first magnet.

12. An ignition distributor according to claim 8, in which each of said second electrodes is provided with projections extending toward and in engagement with said piezo-conductive plate.

* * * * *